United States Patent [19]

Hyde

[11] 4,201,630

[45] May 6, 1980

[54] CLEANING COKE OVEN DOORS OR DOOR JAMBS

[75] Inventor: Eric A. Hyde, Bromley, England

[73] Assignee: British Steel Corporation, London, England

[21] Appl. No.: 928,920

[22] Filed: Jul. 28, 1978

[30] Foreign Application Priority Data

Aug. 5, 1977 [GB] United Kingdom ..... 32913/77

[51] Int. Cl.[2] ..... C10B 43/08

[52] U.S. Cl. ..... 202/241; 15/93 A; 134/167 R; 134/181

[58] Field of Search ..... 202/241, 248; 201/2; 134/167 R, 172, 180, 181; 15/93 A

[56] References Cited

U.S. PATENT DOCUMENTS 3,892,250 7/1975 Miko ..... 15/93 A X 3,971,092 7/1976 Stanke et al. ..... 202/241 X

FOREIGN PATENT DOCUMENTS 2265337 10/1975 France ..... 134/172

867761 5/1961 United Kingdom ..... 202/241

*Primary Examiner*—Arnold Turk

*Attorney, Agent, or Firm*—Jesse B. Grove, Jr.

[57] ABSTRACT

Machine for cleaning the peripheral sealing surfaces of rectangular coke oven doors or door jambs. A high pressure water jet nozzle is mounted on an eight-wheeled carriage, the nozzle being directed at the sealing surface to be cleaned. The carriage is driven by a chain drive around a closed rectangular track formed by four tubular members which are held in fixed spatial relationship with one another by supports, thereby positively locating the carriage in all directions except its direction of travel.

7 Claims, 3 Drawing Figures

CLEANING COKE OVEN DOORS OR DOOR JAMBS

This invention relates to the cleaning of coke oven doors or door jambs. In particular it is concerned with the semi-automatic cleaning of tall rectangular doors or door jambs which may be as much as six metres high.

It has been proposed to use high pressure water sprays for the removal of carbonaceous deposits from the sealing surfaces of doors or door jambs in order to obtain more effective sealing and thereby reduce noxious emissions. The jet nozzles may be mounted on carriages which are conveyed parallel to the sealing surface by means of a chain drive. It has now been found that the precise and consistent location of the nozzles relative to the sealing surface is extremely important both for efficient cleaning and to avoid damage to the neighbouring portions of the door or door jamb.

According to one aspect of the invention a cleaning machine is provided for a vertical coke oven door or door jamb having a peripheral sealing surface, said machine including means for directing a high pressure water jet on to the peripheral sealing surface to remove tarry deposits from the exposed sealing surface, a multi-wheeled carriage to which the jet directing means is attached, and a closed track which includes four longitudinally extending members held in fixed spatial relationship with one another by support members, the wheels of said carriage bearing against said members so as to positively locate the carriage in all directions except its directions of travel.

The track may include four tubular members of circular cross-section. Alternatively the tubular members may each have only a portion of their surfaces which is curved.

The wheels of the carriage may have curved peripheral portions which bear against matching surfaces of the longitudinally extending members. The carriage may have eight wheels arranged such that two wheels bear against each longitudinally extending member. The wheels may be arranged in two sets of four. Each set may have a common axle.

The support members for the track may be spaced at intervals along the track and have a shape in the form of a C which opens towards the inside of the closed track.

The carriage may be driven around the track by a chain mechanism which is in turn driven by an hydraulic motor. Two or more carriages may be attached to the chain mechanism at positions spaced along said chain.

One embodiment of the invention will now be described, by way of example only, with reference to the accompanying drawings, in which.

Figure 1:
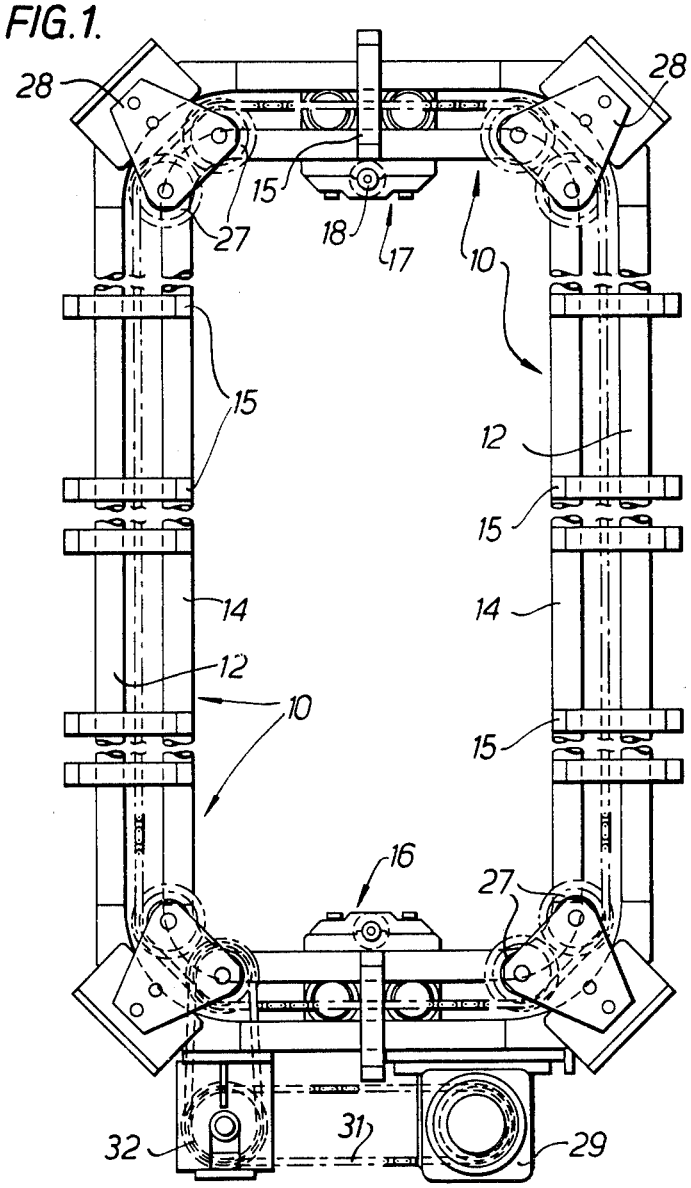
FIG. 1 is an end elevation of a door cleaning machine viewed from the rear.
Figure 2:
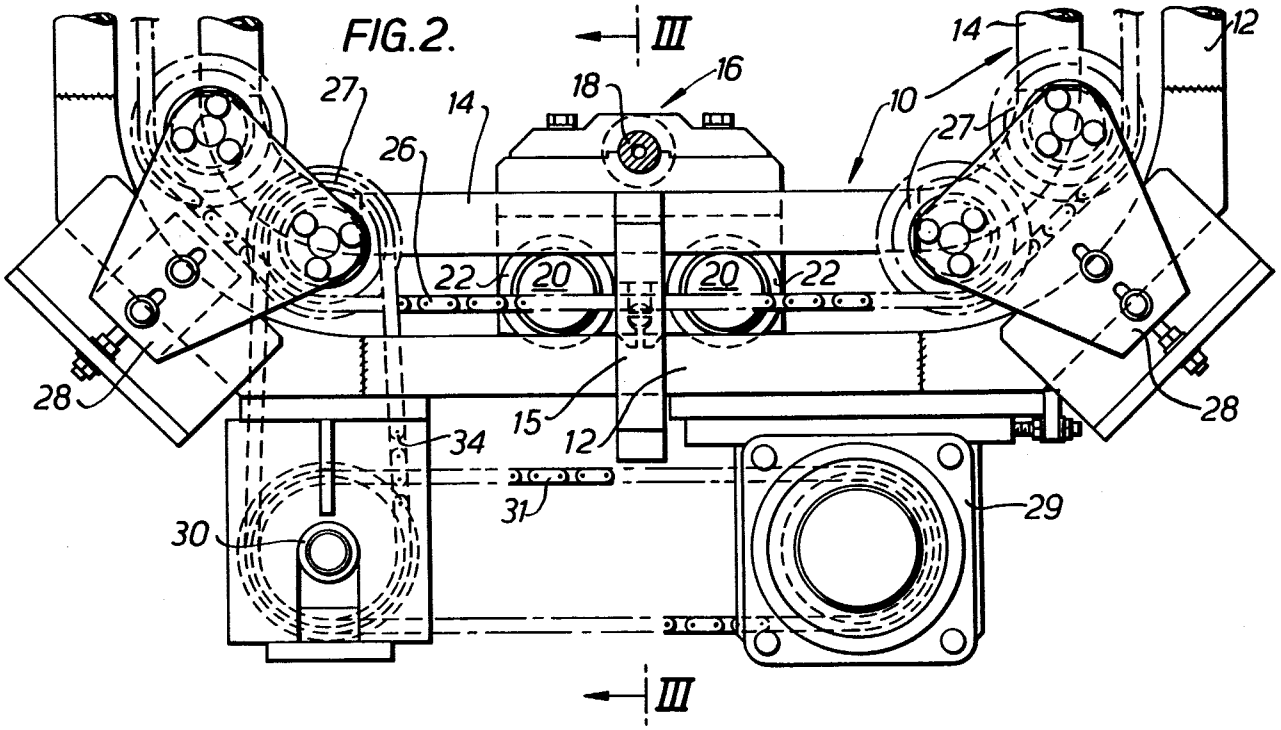
FIG. 2 shows in detail the lower portion of FIG. 1.

The track 10 which is of a generally rectangular shape is shown cut away at three points in FIG. 1. The height of the track 10 is considerably greater than its width. In use the track 10 will be mounted on a suitable frame (not shown) on the coke oven pusher car or guide car.

Track 10 comprises four tubular members 11, 12, 13 and 14 respectively, each of which extend in a closed path of substantially rectangular shape. The exact size and shape of the track 10 is determined by reference to the door or door jamb to be cleaned. In the case of a door, the track 10 is slightly larger in height and width than the rectangle formed by the door sealing surface.

The tubular members 11, 12, 13 and 14 are supported at intervals around track 10 by support plates 15 to which the tubular members 11, 12, 13 and 14 are welded. The plates 15 ensure that the tubular members 11, 12, 13, 14 are held in fixed spatial relationship with one another, i.e. the distance measured between the centre line of each tubular member and any other tubular member remains substantially constant all around the track 10. The two tubular members 11 and 12 form the outside of the track 10, and the two tubular members 13 and 14 form the inside of the track. The spacing apart of tubular members 13 and 14 is greater than that between 11 and 12, and the support plates 15 form a C-shape with the open part of the C between tubular members 13 and 14.

Carriages 16 and 17 run around the track 10. Each carriage has eight wheels arranged in two identical sets of four. Each carriage 16 and 17 carries a water-jet directing member 18 which is rigidly attached by an arm 23 to the respective carriage between the two sets of four wheels, but offset towards the inside of the track 10.

Each set of four wheels runs on a common axle, and comprises an outer pair 19 and 20 whose peripheral surfaces bear respectively on tubular members 13 and 14, and an inner pair 21 and 22 whose peripheral surfaces bear respectively on tubular members 11 and 12. The peripheral surfaces of the wheels 19, 20, 21 and 22 each have a curved portion (seen clearly in FIG. 3) which is slightly larger than the curvature of the respective tubular member against which each wheel bears so that the curved portion fits closely against the tubular member. It will thus be seen that the carriages 16 and 17 are positively located with respect to the track 10, so that the carriages 16 and 17 are only free to move along the track 10. In other words, it will be obvious from the structure of the track 10 and the placement of wheels 19, 20, 21, and 22 that the carriages 16 and 17, only being free to move along track 10, as already mentioned, are, as a consequence, prevented from moving laterally with respect to the track. In order to ensure that any clearances between the arm 23 and the inner wheels 21 and 22 and between the inner and outer wheels are taken up, spring washers (not shown) may be positioned between the arm 23 and the inner wheels 21 and 22. The clearances may alternatively be taken up by an eccentric axle arrangement, in which the trunnions for the bearings for the inner wheels are eccentric to the trunnions for the two outer wheels.

A bar 24 is attached to the central portion of each carriage 16 and 17 midway between each set of four wheels, but offset with respect to the plane through the centre of each set of wheels. Bar 24 is connected at each of its ends to a respective chain link in one of a pair of chains 25 and 26 which run around the track, one between each of the outer wheels 19 and 20 and the inside of the C-shaped supports 15. The chains 25 and 26 are supported at each corner of the track 10 by pairs of identical sprockets 27 mounted externally of track 10 on adjustable mounting plates 28 secured to the outer tubular members 11 and 12.

A hydraulic motor 29 is suspended beneath the bottom of track 10 and drives an adjacent shaft 30 by means of a chain 31 and sprocket wheel 32. Shaft 30 has sprockets at either end connected by chains 33 and 34 to sprockets in the same plane mounted on the axles supporting sprockets 27 at one of the lower corners of track 10. Torque from the hydraulic motor 29 is thus transmitted through chain 31 to axle 30 and then through chains 33 and 34 to drive chains 25 and 26 which extend around the track.

The chains can be driven in one or both directions, and the motor control can be arranged to drive chains 25 and 26 backwards and forwards in a reciprocating manner. In this way carriages 16 and 17 are moved around track 10.

The water-jet directing member 18 which is rigidly attached to each carriage 16, 17 has a head 35. The head 35 carried a water jet nozzle (not shown) which directs a spray of water parallel to the axis of directing member 18. The member 18 in use is connected with a suitable water supply which transmits water under high pressure (4–10,000 psi) to the water jet nozzle. A water jet nozzle assembly such as that described in American Application Ser. No. 862199, now U.S. Pat. No. 4,151,852 may take the place of the member 18 and its hed 35. The jet nozzle used may be of the type described in American Application Ser. No. 862200, now abandoned.

Figure 3:
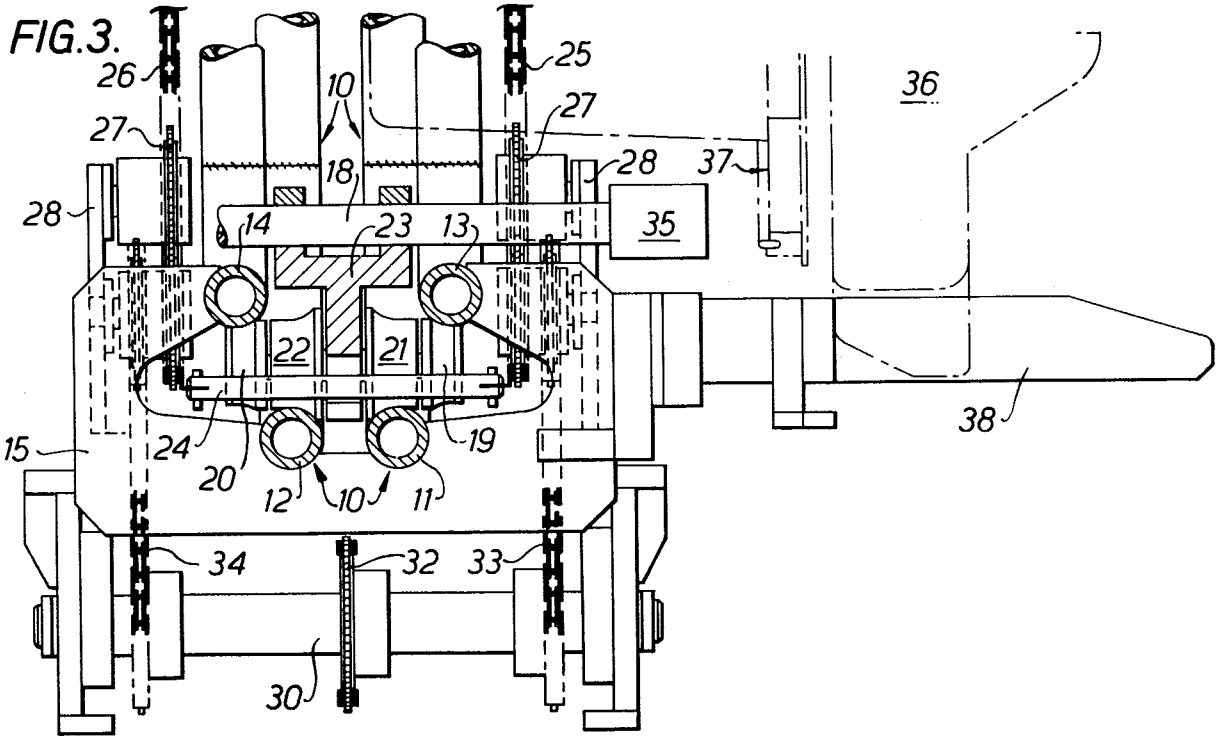
FIG. 3 is a view on III—III of FIG. 2, showing a door to be cleaned in chain-dotted line.

In FIG. 3, a coke oven door 36 to be cleaned is shown in chain-dotted line, and the sealing surface is identified by numeral 37. The door 36 is located relative to the cleaning machine by lugs 38 at the top and bottom of the frame holding the track 10. The motor 29 is then activated, together with the high pressure water supply means, and the water-jet directing member 18 is driven on its carriage around the track 10, cleaning the sealing surface 37 of the door by a jet or jets of high pressure water which blasts away the carbonaceous deposits.

The accurate and positive location of the jet-directing means relative to the door ensures that consistent and proper cleaning of the sealing surface 37 takes place without any damage to adjoining portion of the door 36. The sealing surface 37 is held at a fixed and known distance from the jet nozzle, and relatively lower water pressures can be used than would otherwise be the case, since the sealing surface can be held consistently close to the jet nozzle.

We claim:

1. A cleaning machine for a vertical coke oven door or door jamb having a peripheral sealing surface, said machine including means for directing a high pressure water jet on to the peripheral sealing surface to remove tarry deposits from the exposed sealing surface, a multi-wheeled movable carriage to which the jet directing means is attached, and a closed track which includes four longitudinally extending members held in fixed quadrilateral spatial relationship with one another by support members, the wheels of said carriage comprising at least two longitudinally spaced sets of four wheels, the wheels of each set bearing against separate longitudinally extending members so as to positively orient the carriage in relation to said members whereby said carriage is free to move only along said closed track and lateral and tilting movement of the carriage with respect to the track is prevented.

2. A cleaning machine according to claim 1 in which the wheels of the carriage have curved peripheral portions which bear against matching surfaces of the longitudinally extending members.

3. A cleaning machine as claimed in claim 1 in which the track includes four tubular members of circular cross-section.

4. A cleaning machine according to claim 1 in which each set has a common axle.

5. A cleaning machine according to claim 1 in which the support members for the track are spaced at intervals along the track and have a shape in the form of a C which opens towards the inside of the closed track.

6. A cleaning machine according to claim 1 in which the carriage is driven around the track by a chain mechanism which is in turn driven by a hydraulic motor.

7. A cleaning machine according to claim 6 in which a plurality of carriages are attached to the chain mechanism at spaced positions along said chain.

* * * * *